US010702964B2

(12) United States Patent
Lutjen et al.

(10) Patent No.: US 10,702,964 B2
(45) Date of Patent: Jul. 7, 2020

(54) BLADE OUTER AIR SEAL SURFACE

(71) Applicant: United Technologies Corporation, Farmington, CT (US)

(72) Inventors: Paul M. Lutjen, Kennebunkport, ME (US); Patrick D. Couture, Tolland, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 86 days.

(21) Appl. No.: 15/830,450

(22) Filed: Dec. 4, 2017

(65) Prior Publication Data

US 2018/0085880 A1 Mar. 29, 2018

Related U.S. Application Data

(63) Continuation of application No. 14/176,669, filed on Feb. 10, 2014, now Pat. No. 9,833,869.

(60) Provisional application No. 61/763,231, filed on Feb. 11, 2013.

(51) Int. Cl.

| | |
|---|---|
| ***B24B 1/00*** | (2006.01) |
| ***B24B 19/26*** | (2006.01) |
| ***F01D 11/12*** | (2006.01) |

(52) U.S. Cl.

CPC ..... *B24B 1/00* (2013.01); *B24B 19/26* (2013.01); *F01D 11/12* (2013.01); *F05D 2240/11* (2013.01); *F05D 2250/15* (2013.01); *F05D 2250/712* (2013.01); *F05D 2250/73* (2013.01); *Y10T 29/49982* (2015.01)

(58) Field of Classification Search

CPC ..... F01D 11/12

See application file for complete search history.

(56) References Cited

U.S. PATENT DOCUMENTS

| | | | | |
|---|---|---|---|---|
| 4,540,336 | A * | 9/1985 | Cawley | F01D 11/122 415/173.4 |
| 4,650,394 | A | 3/1987 | Weidner | |
| 5,439,348 | A | 8/1995 | Hughes et al. | |
| 6,409,471 | B1 * | 6/2002 | Stow | F01D 11/08 29/888.022 |
| 6,726,448 | B2 * | 4/2004 | McGrath | F01D 11/12 415/173.3 |
| 7,255,929 | B2 * | 8/2007 | Tumquist | F01D 11/08 416/174 |
| 7,726,936 | B2 * | 6/2010 | Keller | F01D 11/12 415/173.4 |

(Continued)

*Primary Examiner* — Christopher Verdier
*Assistant Examiner* — Jason A Fountain
(74) *Attorney, Agent, or Firm* — Cantor Colburn LLP

(57) ABSTRACT

A blade outer air seal for a gas turbine engine having a surface that is eccentric with respect to the engine rotation centerline, and a method for creating same, are disclosed. Also, a method for grinding a work piece having nominal curvature defined by a work piece curvature centerline is disclosed, comprising the steps of: a) determining a desired surface profile for the work piece; b) providing a rotating grinding surface having a grinding rotation centerline; c) offsetting the grinding rotation centerline from the work piece curvature centerline; and d) applying the rotating grinding surface to the work piece while rotating the rotating grinding surface about the grinding rotation centerline to create the desired surface profile.

13 Claims, 5 Drawing Sheets

(56) References Cited

U.S. PATENT DOCUMENTS

| | | | | |
|---|---|---|---|---|
| 8,100,640 | B2 | 1/2012 | Strock et al. | |
| 8,684,669 | B2 * | 4/2014 | Chehab | F01D 11/122 415/118 |
| 9,062,558 | B2 | 6/2015 | Joe et al. | |
| 9,938,849 | B2 * | 4/2018 | Strock | F01D 11/122 |
| 2003/0215328 | A1 * | 11/2003 | McGrath | F01D 11/12 415/173.3 |
| 2005/0129976 | A1 * | 6/2005 | Tumquist | F01D 11/08 428/680 |
| 2010/0104426 | A1 * | 4/2010 | Keller | F01D 11/12 415/173.1 |
| 2012/0207586 | A1 * | 8/2012 | Chehab | F01D 11/122 415/118 |
| 2016/0189702 | A1 | 6/2016 | Blanc et al. | |
| 2016/0251976 | A1 * | 9/2016 | Strock | F01D 11/122 277/411 |

* cited by examiner

BLADE OUTER AIR SEAL SURFACE

CROSS-REFERENCE TO RELATED APPLICATIONS

This application is a continuation application of the legally related U.S. application Ser. No. 14/176,669, filed Feb. 10, 2014, which claims the benefit of U.S. Provisional Application Ser. No. 61/763,231, filed Feb. 11, 2013, the contents of which are both incorporated by reference herein in their entireties.

TECHNICAL FIELD OF THE DISCLOSURE

The present disclosure generally related to turbine engines and, more specifically, to a blade outer air seal of a turbine engine.

BACKGROUND OF THE DISCLOSURE

Axial turbine engines generally include fan, compressor, combustor and turbine sections positioned along an axial centerline sometimes referred to as the engine's "axis of rotation" The fan, compressor, and combustor sections add work to air (also referred to as "core gas") flowing through the engine. The turbine extracts work from the core gas to drive the fan and compressor sections. The fan, compressor, and turbine sections each include a series of stator and rotor assemblies. The stator assemblies, which do not rotate (but may have variable pitch vanes), increase the efficiency of the engine by guiding core gas flow into or out of the rotor assemblies.

Each rotor assembly typically includes a plurality of blades extending out from the circumference of a disk. Platforms extending laterally outward from each blade collectively form an inner radial flowpath boundary for core gas passing through the rotor assembly. An outer case, including blade outer air seals (BOAS), provides the outer radial flow path boundary. The blade outer air seal aligned with a particular rotor assembly is suspended in close proximity to the rotor blade tips to seal between the tips and the outer case. The sealing provided by the blade outer air seal helps to maintain core gas flow between rotor blades where the gas can be worked (or have work extracted).

Disparate thermal growth between the rotor assembly and the outer case can cause the rotor blade tips to "grow" radially and interfere with the aligned blade outer air seal. In some applications, the gap between the rotor blade tips and the blade outer air seal is increased to avoid the interference. A person of skill in the art will recognize, however, that increased gaps tend to detrimentally effect the performance of the engine, thereby limiting the value of this solution. In other applications, the blade outer air seals comprise an abradable material and the blade tips include an abrasive coating to encourage abrading of the blade outer air seals. The blade tips abrade the blade outer air seal until a customized clearance is left which minimizes leakage between the rotor blade tips and the blade outer air seal.

Improvements are therefore needed in turbine engine rotor assembly blade outer air seals that decrease the flow of core gas around the rotor blade tips to increase turbine engine efficiency.

SUMMARY OF THE DISCLOSURE

In one embodiment, a blade outer air seal for a gas turbine engine having an engine rotation centerline is disclosed, comprising: a substrate having a first end and a second end, wherein a blade within the engine rotates past the first end and then past the second end when the engine is running; a coating applied to the substrate; wherein the substrate and the coating define a first combined thickness at the first end and a second combined thickness at the second end; wherein the first combined thickness is selected from the group consisting of: greater than and less than, the second combined thickness.

In another embodiment, a blade outer air seal for a gas turbine engine having an engine rotation centerline is disclosed, comprising: a substrate; and a coating applied to the substrate; wherein a surface of the coating is eccentric with respect to the engine rotation centerline when the blade outer air seal is mounted within the engine.

In another embodiment, a method for creating a blade outer air seal for a gas turbine engine having an engine rotation centerline is disclosed, comprising the steps of: a) determining a desired surface profile for the blade outer air seal; b) providing a rotating grinding surface having a grinding rotation centerline; c) determining where the engine rotation centerline would be if the blade outer air seal were mounted in the engine; d) offsetting the grinding rotation centerline from the engine rotation centerline; and e) applying the rotating grinding surface to the blade outer air seal while rotating the rotating grinding surface about the grinding rotation centerline to create the desired surface profile.

In another embodiment, a method for grinding a work piece having nominal curvature defined by a work piece curvature centerline is disclosed, comprising the steps of: a) determining a desired surface profile for the work piece; b) providing a rotating grinding surface having a grinding rotation centerline; c) offsetting the grinding rotation centerline from the work piece curvature centerline; and d) applying the rotating grinding surface to the work piece while rotating the rotating grinding surface about the grinding rotation centerline to create the desired surface profile.

Other embodiments are also disclosed.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
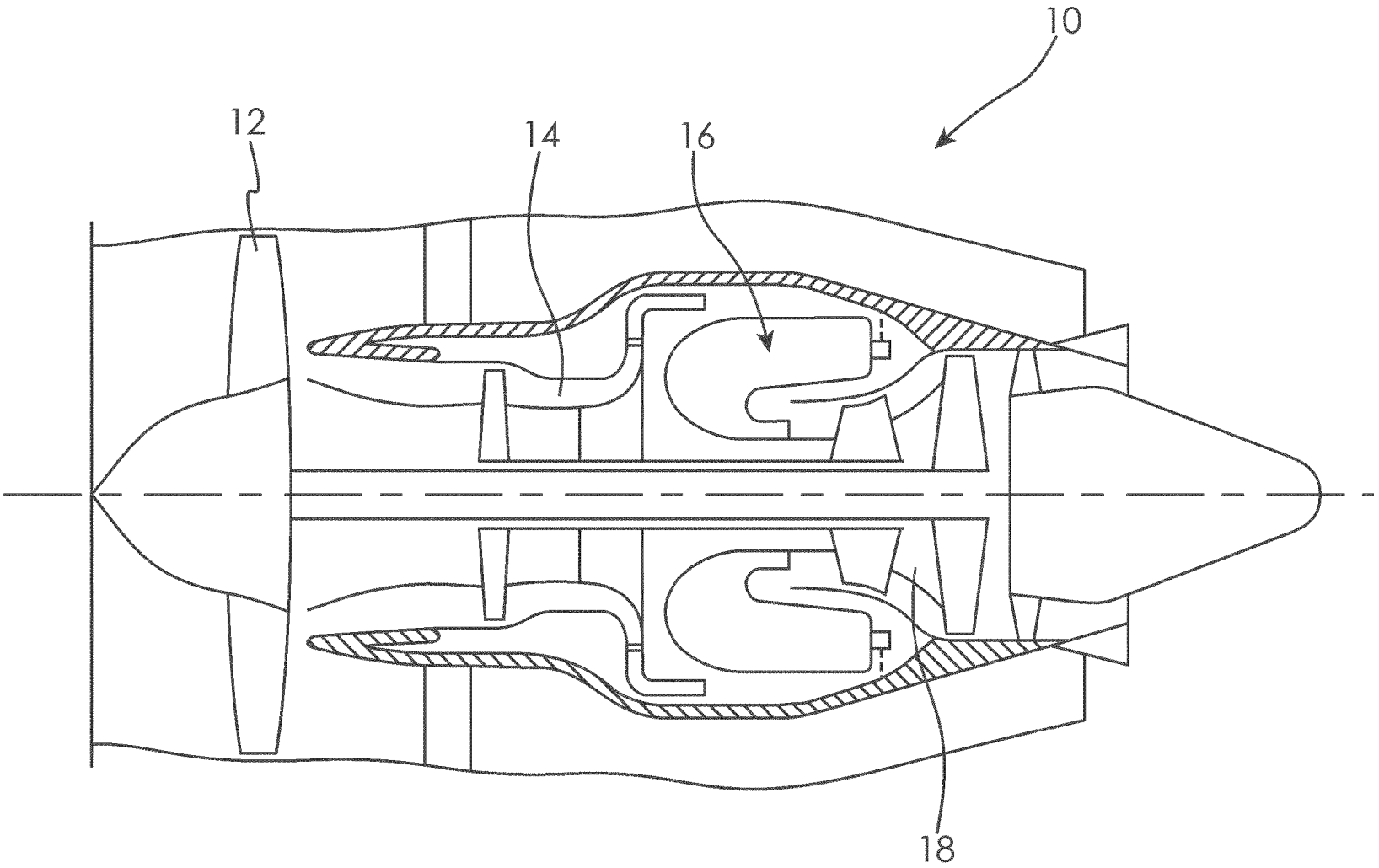
FIG. 1 is a schematic cross-sectional view of a gas turbine engine.

FIG. 1 illustrates a gas turbine engine 10 of a type normally provided for use in a subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
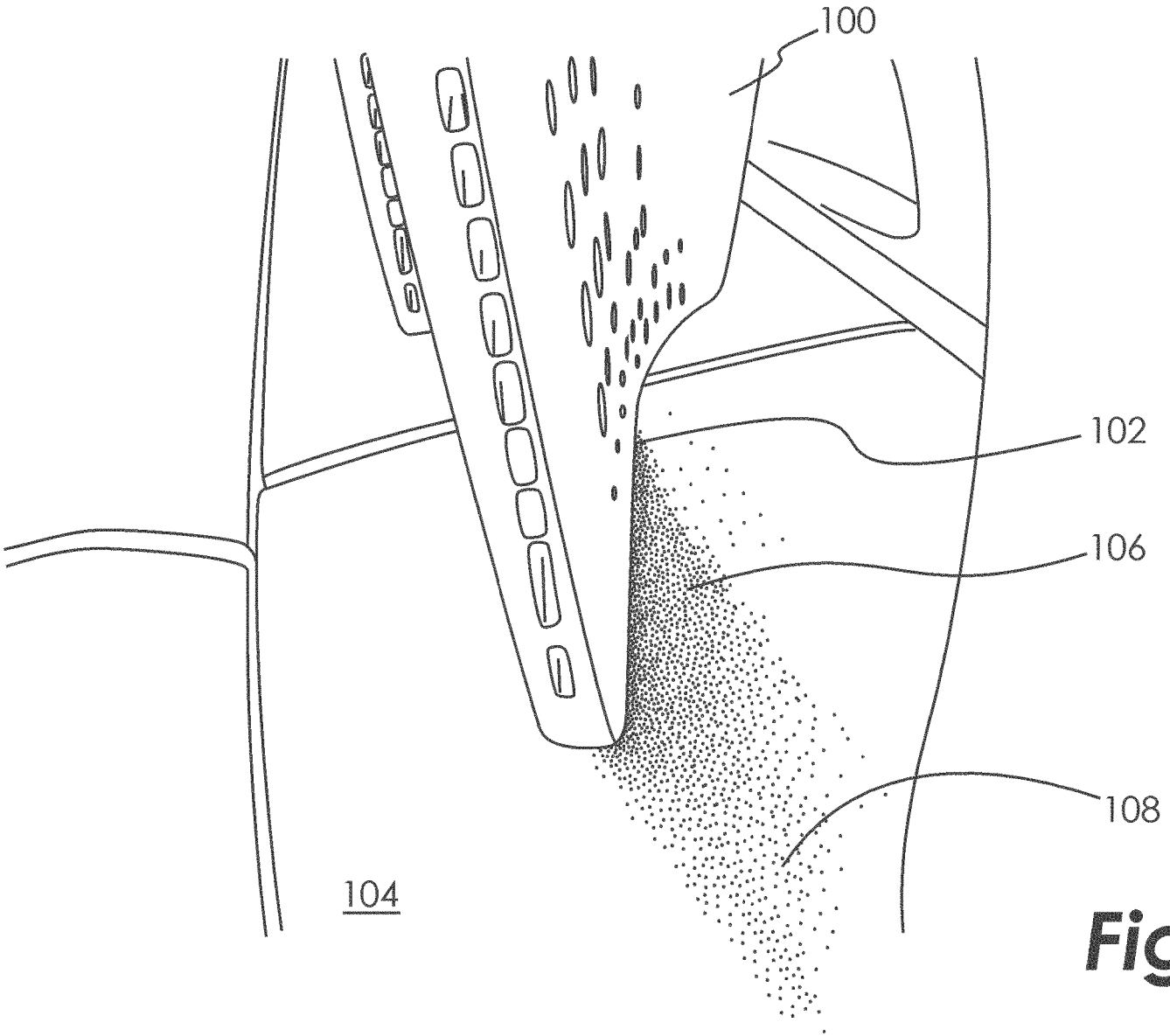
FIG. 2 is a partial perspective view of a first stage high pressure turbine blade and blade outer air seal showing an inconsistent rub pattern.

It has been observed in some turbine engines that the blades of the first stage high pressure turbine create an inconsistent rub on the blade outer air seal. Referring to FIG. 2, there is shown a close-up view of a first stage high pressure turbine blade 100. As is known in the art, gases flowing through the turbine engine impact the blade 100, thereby causing rotation of the high pressure turbine. The blade 100 moves away from the viewer in the view of FIG. 2 when it is rotating.

The distal end 102 of the blade 100 is designed to rub against the segmented blade outer air seal 104, thereby providing a seal to prevent gases from flowing between the blade 100 and the blade outer air seal 104. Energy that may be imparted to the turbine is lost when such gases bypass the turbine blade, reducing the efficiency of the engine. The area 106 of heavy rubbing on the surface of the blade outer air seal 104 indicates consistent contact with the distal end 102 of the blade 100 as it rotates by the blade outer air seal 104, forming an effective seal therebetween.

In some situations, portions of the blade outer air seal 104 may move farther away from the distal end 102 of the blade 100 during hot conditions of the engine. This may be caused by one or more of a variety of causes, including heat, pressure, loads or movement of adjoining hardware, etc. The area 108 of light and inconsistent rubbing is indicative of this problem. Because the distal end 102 of the blade 100 does not make consistent contact with the blade outer air seal 104 in the region 108, energy that would otherwise by transferred to the blade 100 is lost and the efficiency of the turbine is decreased.

There is therefore a need for apparatuses and methods for ensuring consistent contact between the distal end 102 of the blade 100 and the surface of the blade outer air seal 104. The presently disclosed embodiments are directed toward solving this problem.

In the presently disclosed embodiments, methods are disclosed for creating a non-uniform radial distance from the centerline of a turbine engine to the inner surface of a static piece of hardware, such as a first stage high pressure turbine blade outer air seal. By varying this distance, it is possible to promote substantially consistent rub between hardware rotating around the engine centerline and static hardware positioned at a nominal radial distance from the engine centerline Although the concept is described herein with respect to rotating blades of a first stage high pressure turbine and a segmented blade outer air seal for such turbine, it will be appreciated from the present disclosure that the disclosed concepts may be employed with any system where it is desired to precisely control the contact (or gap) between a piece of rotating hardware and a piece of static hardware. For example, the presently disclosed concepts are also applicable to any rotating hardware on a turbine engine where it is desired to precisely control the contact (or gap) between the rotating hardware and a piece of static hardware.

Figure 3A:
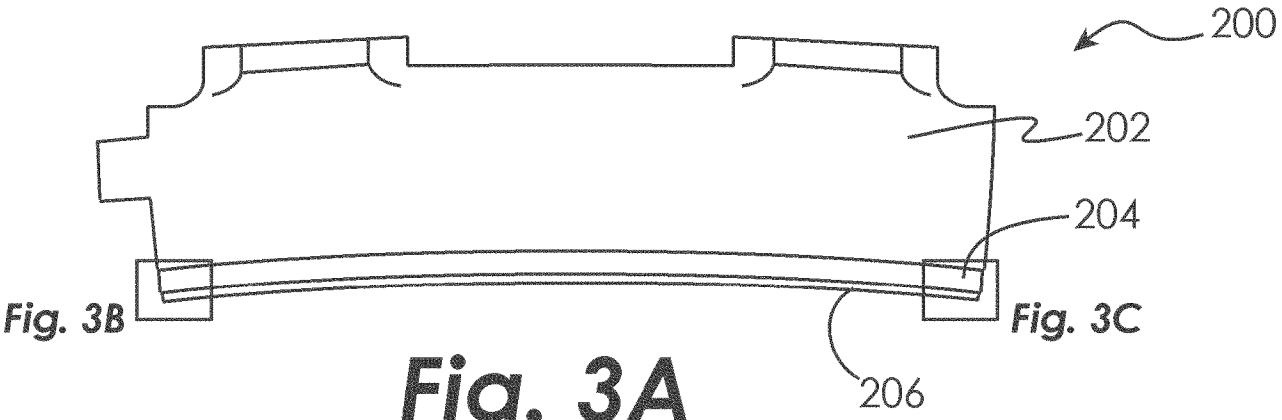
FIGS. 3A-C are elevational views of a blade outer air seal exhibiting a nonuniform coating thickness across its surface, according to one disclosed embodiment.

Referring now to FIG. 3A, one segment of a blade outer air seal 200 according to one embodiment is illustrated in profile. The blade outer air seal 200 consists of a main body 202 to which is applied a thermal barrier coating 204, as is known in the art. It is desired that the distal end 102 of the blade 100 maintain consistent contact with the thermal barrier coating 204 as the distal end 102 of the blade 100 moves across the surface of the blade outer air seal 200.

Figure 3C:
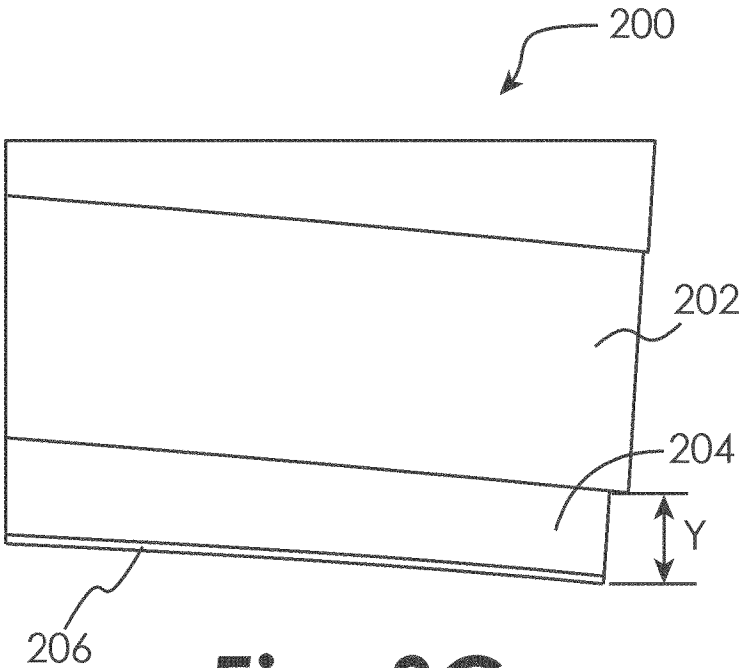
Figure 3B:
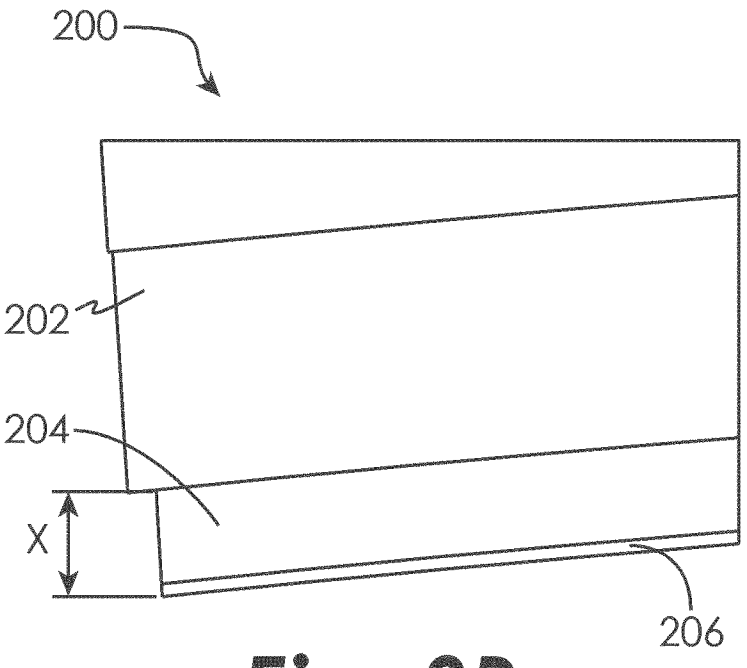

In situations where it is observed that the distal end 102 of the blade 100 is not making consistent contact, such as in the situation illustrated in FIG. 2, the seal may be repaired by applying a second layer 206 to the thermal barrier coating 204. The second layer 206 may comprise the same material as the thermal barrier coating 204 or a different material, as desired. It can be seen that at the end of the blade outer air seal 200 shown in close-up in FIG. 3B, the second layer 206 is thicker than the thickness of the second layer 206 shown in close-up in FIG. 3C at the opposite end of the blade outer air seal 200. This causes a total coating thickness of X in the portion shown in FIG. 3B and a total coating thickness of Y in the portion shown in FIG. 3C, where X>Y. The blade outer air seal 200 is thereby moved closer to the distal end 102 of the blade 100 on the end of the blade outer air seal 200 in the portion shown in FIG. 3B, and the thicker coating 206 will promote rub on the side that previously had reduced contact, thereby closing the gap that was previously causing inconsistent contact therebetween. It will be appreciated from the present disclosure that the thicker coating thickness may be located at any desired portion of the static hardware.

Figure 4:
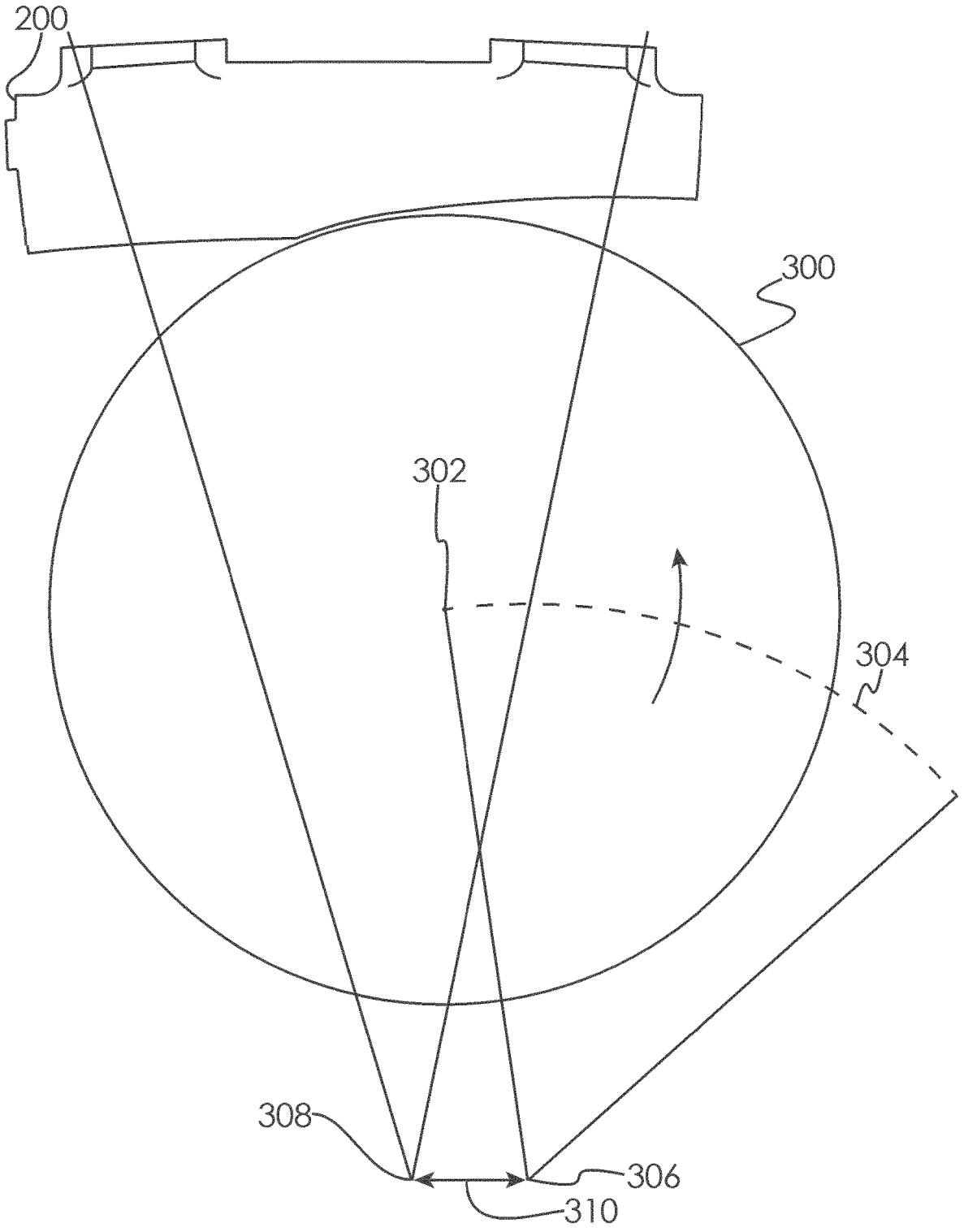
FIG. 4 is a schematic elevational view illustrating an eccentric grinding device and method according to one disclosed embodiment.

The differing thicknesses X and Y, as well as the smooth transition therebetween (i.e., the desired surface profile), may be created by grinding the second layer to an inconsistent thickness across the width of the blade outer air seal 200. One embodiment method for creating such a profile is illustrated schematically in FIG. 4. A work piece, such as a blade outer air seal 200 to name just one non-limiting example, may be ground by a rotating grinding surface 300 that rotates about a grinding axis 302. The grinding axis 302 may be moved in an arc 304 during the grinding process, the arc having a grinding rotation centerline 306. The work piece may have its own nominal curvature defined by a work piece curvature centerline 308. For example, if the work piece is a blade outer air seal 200 for use in a gas turbine engine having an engine rotation centerline, the work piece curvature centerline 308 coincides with the engine rotation centerline (i.e., where the engine rotation centerline would be if the blade outer air seal 200 were currently mounted within the engine). By offsetting the grinding rotation centerline 306 from the engine rotation centerline 308 by a distance 310, an eccentrically ground surface will be created on the blade outer air seal 200.

Therefore, in one embodiment the method for creating the eccentrically ground surface comprises the steps of: a) determining a desired surface profile for the blade outer air seal 200; b) providing a rotating grinding surface 300 having a grinding rotation centerline 306; c) determining where the engine rotation centerline 308 would be if the blade outer air seal 200 were mounted in the engine; d) offsetting the grinding rotation centerline 306 from the engine rotation centerline 308 by the distance 310; and e) applying the rotating grinding surface 300 to the blade outer air seal while rotating the rotating grinding surface 300 about the grinding rotation centerline 306 to create the desired surface profile.

The configuration and method discussed hereinabove with a two layer (204 and 206) configuration is well-suited to repair scenarios, as the existing structure is left intact and material is added thereto and ground to the desired surface profile. In other embodiments, the second layer 206 is omitted and the thermal barrier coating 204 is subjected to the eccentric grinding process. This is useful in applications where it is not required to keep a uniform thickness to the thermal barrier coating. In other embodiments, the ground substrate 202 (which is typically metal, but may be formed from any desired material) is ground to the desired shape, and then a uniform coating of the thermal barrier coating 204 is applied thereto.

Figure 5:
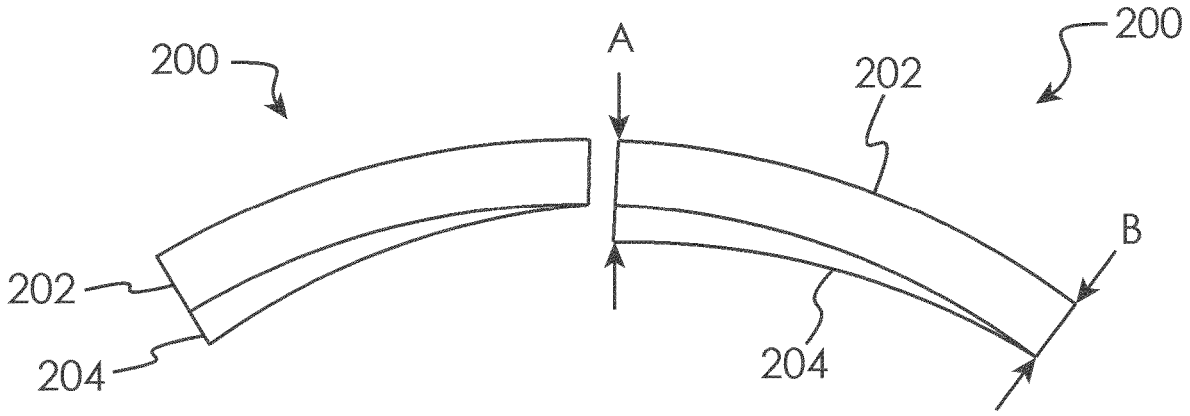
FIG. 5 is a schematic elevational view of a series of blade outer air seals, each having an eccentrically ground surface, according to one disclosed embodiment.

As shown in FIG. 5, a series of blade outer air seals 202, each having an eccentrically ground surface, may be mounted within a gas turbine engine. It can be seen that the thickness A on a first end of the blade outer air seal 200 is greater than a thickness B on a second end of the blade outer air seal 200. The eccentric grind, either to the blade outer air seal substrate 202 or to the thermal barrier coating 204, on each of the blade outer air seals 200 creates a stair step configuration when the blade outer air seals 200 are mounted in the engine and are cold. Choosing the proper eccentric profile will result in a circular flowpath at the thermal barrier coating 204 surface in the running engine when the blade outer air seals 200 are subjected to the forces discussed above.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected. For example, those skilled in the art will recognize that in some embodiments the work piece that is ground may be something other than a blade outer air seal, as well as something other than a part of a gas turbine engine. The disclosed concepts are applicable for creating an eccentric profile on any type of workpiece.

The invention claimed is:

1. A blade outer air seal for a gas turbine engine having an engine rotation centerline, comprising:

a substrate having a first end and a second end, wherein a blade within the engine rotates past the first end and then past the second end when the engine is running; and a coating applied to the substrate; wherein the substrate and the coating define a first combined thickness at the first end and a second combined thickness at the second end;

wherein the first combined thickness is different from the second combined thickness, wherein the first end is at a first edge of the blade outer air seal and the second end is at a second edge of the blade outer air seal, wherein the coating has a first thickness at the first end and a second thickness at the second end such that the coating varies in thickness in a circumferential direction with respect to the engine rotation centerline, and wherein the substrate has a substantially uniform thickness, wherein, during operation, the blade outer air seal is configured to ensure a blade contact with the coating at the first edge and at the second edge due to the first combined thickness at the first end and the second combined thickness at the second end.

2. The blade outer air seal of claim 1, wherein the coating comprises a thermal barrier coating.

3. The blade outer air seal of claim 1, wherein a surface of the substrate is eccentric with respect to the engine rotation centerline.

4. The blade outer air seal of claim 1, wherein:

a first surface of the substrate is not eccentric with respect to the engine rotation centerline; and a second surface of the coating is eccentric with respect to the engine rotation centerline.

5. The blade outer air seal of claim 4, wherein the coating comprises a thermal barrier coating.

6. The blade outer air seal of claim 1, wherein the coating has a smooth transition from the first end to the second end.

7. A gas turbine engine having an engine rotation centerline, comprising:

a plurality of blade outer air seals mounted within the engine, wherein each blade outer air seal comprises:

a substrate; and a coating applied to the substrate;

wherein a surface of the coating of each blade outer air seal is eccentric with respect to the engine rotation centerline when the blade outer air seal is mounted within the engine such that each coating has a first thickness at a first end of a respective blade outer air seal and a second thickness at a second end of the respective blade outer air seal, wherein the first end is at a first edge of the respective blade outer air seal and the second end is at a second edge of the respective blade outer air seal and wherein the first and wherein the first thickness is different than the second thickness, and wherein the plurality of blade outer air seals form a stair step configuration when mounted within the engine, wherein, during operation, each blade outer air seal of the plurality of blade outer air seals is configured to ensure a blade contact with the coating at the first edge and at the second edge due to the first thickness at the first end and the second thickness at the second end.

8. The gas turbine engine of claim 7, wherein the coating of each blade outer air seal is a thermal barrier coating.

9. The gas turbine engine of claim 7, wherein the substrate of each blade outer air seal is uniform in thickness.

10. The gas turbine engine of claim 7, wherein a surface of each substrate of the plurality of blade outer air seals is eccentric with respect to the engine rotation centerline.

11. The gas turbine engine of claim 7, wherein:

a first surface of the substrate is not eccentric with respect to the engine rotation centerline; and a second surface of the coating is eccentric with respect to the engine rotation centerline.

12. The gas turbine engine of claim 11, wherein the coating comprises a thermal barrier coating.

13. The gas turbine engine of claim 7, wherein:

wherein a blade within the engine rotates past the first end and then past the second end when the engine is running, the substrate and the coating define a first combined thickness at the first end and a second combined thickness at the second end, and the first combined thickness is different from the second combined thickness.

* * * * *